US009010429B2

(12) United States Patent
Shampine

(10) Patent No.: US 9,010,429 B2
(45) Date of Patent: Apr. 21, 2015

(54) INTEGRATED WELL ACCESS ASSEMBLY AND METHOD

(75) Inventor: Rod Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 465 days.

(21) Appl. No.: 11/555,427

(22) Filed: Nov. 1, 2006

(65) Prior Publication Data

US 2008/0066915 A1 Mar. 20, 2008

Related U.S. Application Data

(60) Provisional application No. 60/825,784, filed on Sep. 15, 2006.

(51) Int. Cl.

| | |
|---|---|
| ***E21B 43/25*** | (2006.01) |
| ***F04B 9/113*** | (2006.01) |
| ***F04B 47/00*** | (2006.01) |
| ***F04B 47/04*** | (2006.01) |

(52) U.S. Cl.

CPC ..... *E21B 43/25* (2013.01); *F04B 9/113* (2013.01); *F04B 47/00* (2013.01); *F04B 47/04* (2013.01)

(58) Field of Classification Search

USPC ..... 166/383, 384, 77.2, 90.1, 177.5, 305.1

See application file for complete search history.

(56) References Cited

U.S. PATENT DOCUMENTS

| | | | | |
|---|---|---|---|---|
| 3,313,346 | A * | 4/1967 | Cross | 166/352 |
| 4,476,923 | A | 10/1984 | Walling | |
| 4,863,991 | A | 9/1989 | Poppe | |
| 5,180,014 | A | 1/1993 | Cox | |
| 5,511,619 | A | 4/1996 | Jackson | |
| 5,667,369 | A | 9/1997 | Cholet | |
| 5,692,562 | A | 12/1997 | Squires | |
| 5,785,500 | A | 7/1998 | Leniek | |
| 5,941,311 | A | 8/1999 | Newton | |
| 6,220,358 | B1 | 4/2001 | Leniek | |
| 7,051,818 | B2 * | 5/2006 | Crawford et al. | 166/379 |
| 2004/0244993 | A1 * | 12/2004 | Crawford et al. | 166/381 |

OTHER PUBLICATIONS

High Pressure Water Pumps. Dynaset [online]. Apr. 2005 [retrieved Nov. 30, 2009]. Retrieved from the Internet: <URL: http://web.archive.org/web/20050408041340/www.dynaset.com/WWW/High-pressure-water.html >.*

* cited by examiner

*Primary Examiner* — David Andrews

(74) *Attorney, Agent, or Firm* — Michael L. Flynn; Timothy Curington; Robin Nava

(57) ABSTRACT

An embodiment of an integrated well access assembly comprises a prime mover, a positioning pump coupled to the prime mover for positioning a well access line relative to the well, and a hydraulic treating pump coupled to the prime mover for pumping a fluid into the well access line.

25 Claims, 6 Drawing Sheets

INTEGRATED WELL ACCESS ASSEMBLY AND METHOD

CROSS-REFERENCE TO RELATED APPLICATION

This application claims priority under 35 U.S.C. 119(e) to U.S. Provisional Application Ser. No. 60/825,784, filed on Sep. 15, 2006, which is incorporated herein by reference.

BACKGROUND

Embodiments described relate to the employment of pumps at an oilfield for a variety of operations. In particular, embodiments of hydraulic pump assemblies for trailer delivery and employment are described.

BACKGROUND OF THE RELATED ART

Coiled tubing applications may be employed at an oilfield wherein a spool of pipe is slowly straightened and advanced into a well via various pump assemblies. For example, a coiled tubing application may be employed at a well in order to clean out sand or other undesirable debris within the well, perhaps at its terminal end. Similarly, a variety of other line driven applications may be directed to a well for management or treatment thereof.

In order to achieve such a clean out as described above, a coiled tubing assembly may be located at the well site along with a significant amount of additional equipment. In the case of the coiled tubing assembly itself, between about 10,000 feet and about 30,000 feet of coiled tubing may be provided on a reel or spool as indicated above. Coiled tubing from the spool may be fed into an arcuate gooseneck guide arm and injector whereby the injector advances the coiled tubing deep into the well.

As the coiled tubing is advanced into the well, some degree of fluid pressure may be injected into the coiled tubing to ensure that it maintains integrity and does not collapse in the face of higher external pressure which may be present within the well. For example, perhaps a few hundred pounds per square inch (PSI) to a thousand psi of pressure within conventionally sized coiled tubing may be required for this purpose. Furthermore, once advanced within a well at a location desired for a clean out operation, significantly higher pressure through the coiled tubing may be required in order to perform the clean out operation.

In order to meet such high pressure needs within the coiled tubing, a large oilfield pump assembly such as a crankshaft driven triplex pump assembly capable of generating significantly higher pressures than just the few hundred PSI noted above is coupled to the coiled tubing assembly. In this manner, pressure within the coiled tubing may be maintained during its advancement into the well and sufficient additional pressure may be available in order to accomplish the above noted clean out. For example, the crankshaft driven pump may generate about 5,000 PSI or more for the clean out operation. Further, the crankshaft driven pump may be useful in other significant applications, such as use at the high pressure and low flow rate required for pressure testing of blow out preventer hardware.

Each piece of equipment employed at the oilfield comes with significant operational costs. In the above described clean out application, a coiled tubing assembly is provided that may physically be present on an individual platform or skid at the oilfield. Given that the clean out itself is a coiled tubing application, the presence of this particular platform is unavoidable. Unfortunately, however, as noted above, an additional crankshaft driven high pressure assembly is also provided at the site to provide the required high pressure for a clean out application. Thus, added labor and equipment expenses are presented in terms of equipment delivery, maintenance and additional operators.

The above described added expense of the crankshaft driven assembly may be quite significant. For example, a triplex pump is a fairly massive piece of equipment exceeding about 5,000 pounds in weight. In fact, two such pumps might barely fit back to back on an eight foot tractor trailer. Additionally, while such a pump may be used at about 250 Hp-500 Hp to generate about 5,000 PSI for a clean out application as noted above, a triplex pump is configured for higher Hp applications, often in the 500 Hp-1,000 Hp range or larger. For example, the need to reach blow out preventor pressure testing pressures of 5,000 to 15,000 psi mean that the pump must be capable of much higher plunger loads than would be required for the well servicing applications, such an a clean out. Thus, the capacity of the crankshaft driven triplex assembly is generally underutilized during well service applications.

A crankshaft driven triplex pump is a positive displacement pump that may include a plunger driven by a crankshaft toward and away from a chamber in order to dramatically effect a high or low pressure on the chamber. This makes it a good choice for high pressure applications. However, the configuration and use of a significantly large crankshaft make it impractical for incorporation with the coiled tubing assembly trailer and its platform. Thus, a separate trailer and platform must be used for this pump. In addition, a conventional coiled tubing assembly is hydraulically powered. However, a triplex pump requires an additional engine (i.e. prime mover) as part of the crankshaft driven triplex assembly. For this additional reason, a separate trailer and platform is required by use of the triplex pump.

Furthermore, in order to carry out such an application as the above described clean out, a back-up pump is often provided in order to ensure that the coiled tubing does not become trapped within debris of the well, a possible occurrence in the case of pump failure. Thus, by use of prior art methods and devices, a coiled tubing assembly, a triplex pump assembly, and a back-up pump (e.g. another triplex assembly) may all be provided at the same oilfield site for the purpose of a single well clean out or similar application.

SUMMARY

In one embodiment, in order to decrease the cost and space requirements inherent in oilfield equipment, an assembly for accessing a well is provided that includes a single prime mover coupled to both a positioning pump for positioning a well access line within the well, and a hydraulic treating pump for pumping fluid into the well access line.

DETAILED DESCRIPTION

Figure 4:
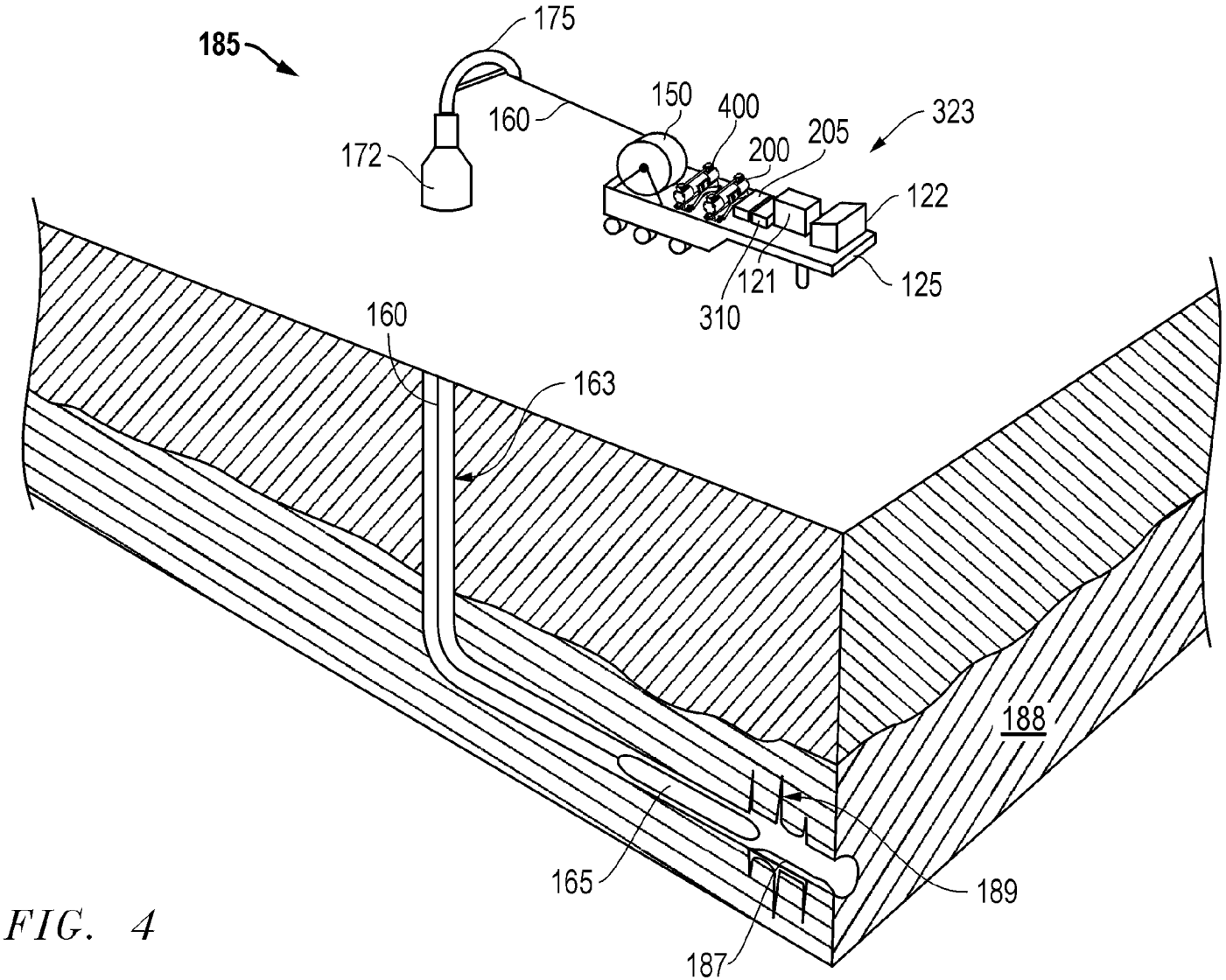
FIG. 4 is a side sectional view of another embodiment of a coiled tubing operation at an oilfield employing a single trailer assembly accommodating the hydraulic treating pump of FIG. 2.

Embodiments are described with reference to certain coiled tubing operations. However, other operations may be involved which take advantage of a single prime mover to operate multiple pumps on a single stage, such as a trailer or a skid assembly. This may be accomplished, for example, by use of a hydraulic treating pump 200, as shown in FIG. 4, rather than a conventional crankshaft driven triplex pump. As shown, and discussed further herein, the hydraulic treating pump 200 lacks a rotating crankshaft of triplex pumps and therefore is much more compact and light weight.

Figure 1:
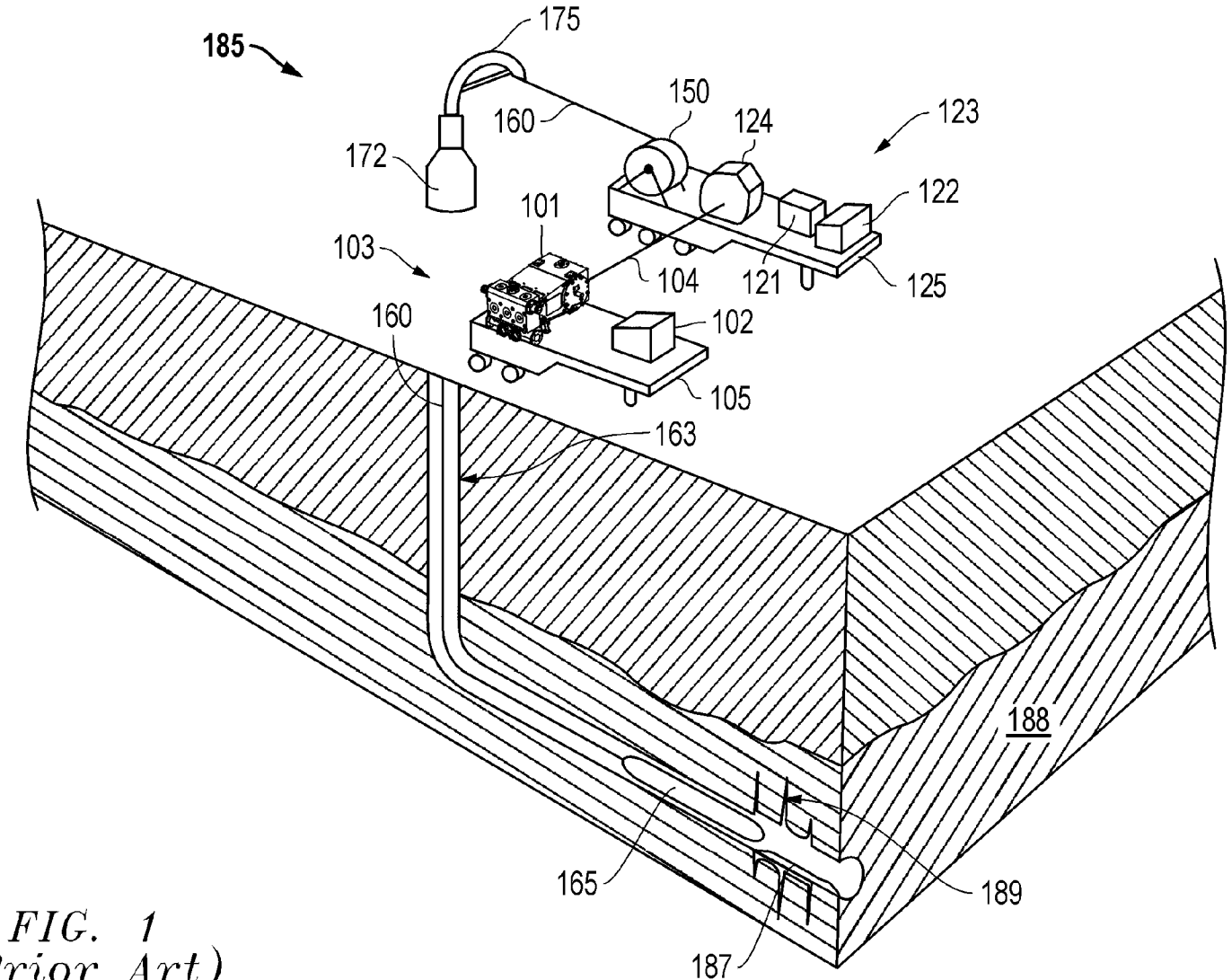
FIG. 1 (Prior Art)
FIG. 1 is a side sectional view of a prior art employment of an operation at an oilfield employing multiple trailer assemblies including one to accommodate a crankshaft driven pump.
Figure 2:
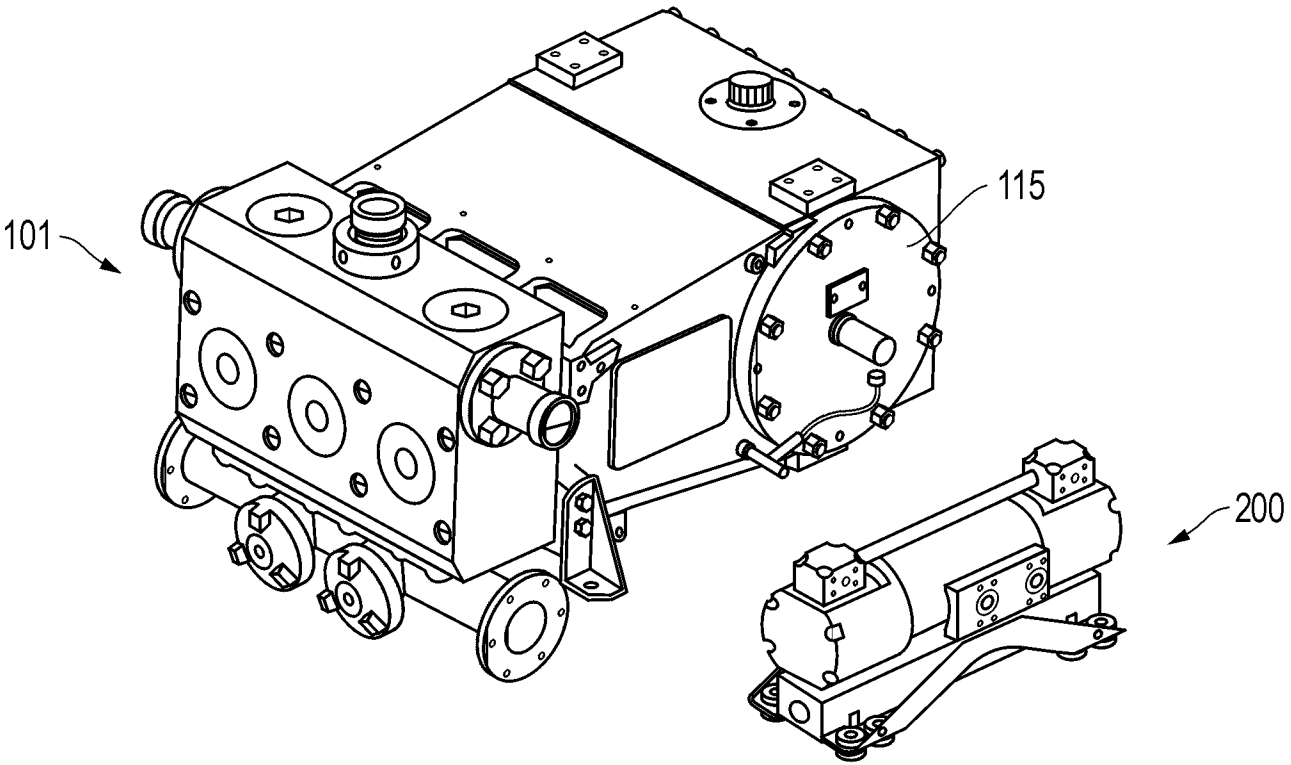
FIG. 2 is a perspective view of the crankshaft driven pump of FIG. 1 adjacent an embodiment of a hydraulic treating pump.
Figure 3:
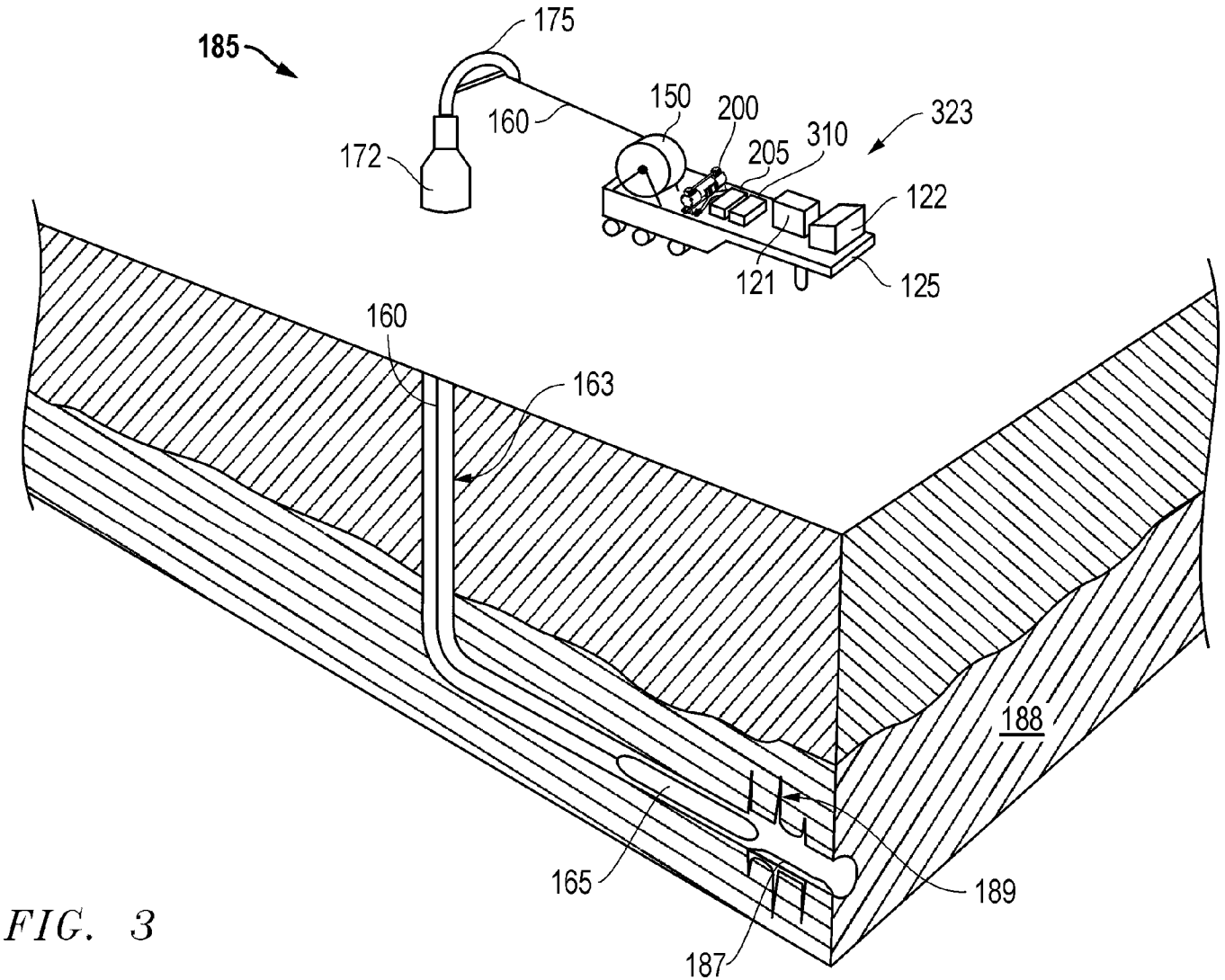
FIG. 3 is a side sectional view of an embodiment of a coiled tubing operation at an oilfield employing a single trailer assembly accommodating the hydraulic treating pump of FIG. 2.

Referring now to FIGS. 1-3, a prior art employment of a coiled tubing operation at an oilfield 185 employing multiple trailer assemblies 103, 123 as shown in FIG. 1, may be viewed in light of an embodiment of a coiled tubing operation employing a single tractor trailer assembly 323 as shown in FIG. 3. This reduction in equipment at the oilfield is made possible by the employment of an embodiment of a hydraulic treating pump 200 as shown in FIG. 2. Thus, an overall reduction in capital equipment for operations at an oilfield 185 may be achieved as described further herein.

With reference to FIGS. 1 and 3 in particular, a coiled tubing operation is shown at an oilfield 185 wherein a line of coiled tubing 160 is advanced into a well 163 as shown. However, embodiments described herein may be applicable to other operations where other types of well access lines are positioned onto or within a well for a variety of purposes. For example, a well fracturing operation, employing up to about 20,000 PSI, may be carried out according to embodiments described further herein.

Continuing with reference to FIGS. 1 and 3, the coiled tubing 160 is guided through a guide arm 175 and into an injector 172. The injector 172 is aligned with the well 163 for providing well access via the coiled tubing 160 as detailed herein. As shown, the well 163 is horizontal. However, a variety of well types may be pertinent. The coiled tubing 160 shown terminates in an application tool 165, in this case a pressure spraying mechanism for a clean out application. Alternatively, a pressure spraying or sealing mechanism may be employed for a fracturing application as noted herein. Additionally, the application tool 165 may be a logging tool or a variety of other tools for applications to be carried out within the well 163. For example, cementing, acidizing, well killing, fracturing, and additional pressure testing applications may be carried out according to embodiments described herein.

Referring again to FIGS. 1 and 3, the application tool 165 is a pressure spraying mechanism for cleaning out debris 187 near a fracture location 189 of the production level 188 at the oilfield 185. That is, in order to enhance production of oil, gas, or other targeted fluid from the production level 188, a coiled tubing operation is being performed to remove debris 187 such as sand from the fracture location 189. In this manner, the fracture location 189 may be unclogged, enhancing the productivity of the well 163.

With particular reference to the prior art coiled tubing operation of FIG. 1 two separate trailer assemblies 103 and 123 are shown. The coiled tubing trailer assembly 123 with coiled tubing reel 150 is naturally provided for the coiled tubing operation. The coiled tubing trailer assembly 123 includes a coiled tubing platform 125 that is equipped with a prime mover 122 which is a conventional engine or power source coupled to a positioning pump 121. The positioning pump 121 may be a hydraulic pump which provides power to the injector 172 for advancing or withdrawing the coiled tubing 160 within the well 163. As described below, a manifold 124 is provided to direct pressure from a crankshaft driven pump 101 to the coiled tubing operation thereby delivering fluid pressure through the coiled tubing 160. As shown in FIG. 1, the crankshaft driven pump 101 is a triplex treating pump of significant size and weight as described further below. As such, the crankshaft driven pump 101 is too large and/or heavy to be incorporated into the coiled tubing platform 125 and must instead be positioned on a separated platform 105.

As indicated above, the coiled tubing 160 is advanced into the well 163 by the combine efforts of the prime mover 122, the positioning pump 121, and the injector 172. However, in coiled tubing operations additional pressure is required for generating high fluid pressure within the coiled tubing 160 itself. For example, to a certain extent pressure within the coiled tubing 160 may be required to maintain integrity and prevent collapse of the coiled tubing 160 as it encounters a potentially high pressure environment of the well 163 as it is advanced therethrough. However, given that the operation shown involves pressure spraying by the application tool 165, additional high pressure is also required for cleaning out the debris 187 once the application tool 165 has been advanced thereto as shown. Pressure testing of the blow out preventer components is also employed before coiled tubing operations begin. Therefore, the above noted crankshaft driven pump 101 is provided to meet all such pressure needs.

Continuing with reference to FIG. 1, a supplemental high pressure trailer assembly 103 is shown. The high pressure trailer assembly 103 includes a high pressure platform 105 to accommodate the crankshaft driven pump 101 as indicated above. An associated high pressure pump prime mover 102 is also provided. The crankshaft driven pump 101 may be coupled to the manifold 124 of the coiled tubing trailer assembly 123 through a high pressure line 104 in order to meet the fluid pressure needs within the coiled tubing 160 as referenced above. As shown in FIG. 1, the crankshaft driven pump 101 is a conventional triplex pump. Such pumps are often employed in oilfield operations such as fracturing operations or the depicted coiled tubing operation. However, it should be noted that a reciprocating plunger pump with other numbers of plungers are also often used in oilfield operations, such as quintuplex pumps (i.e., pumps having 5 plungers.)

With particular reference to FIG. 2, large high pressure crankshaft driven pumps such as the crankshaft driven pump 101 shown come with high expense in terms of capital expenditure. That is, added labor and equipment expenses are presented in terms of equipment delivery, maintenance, additional operators and so forth. As indicated, a crankshaft driven pump 101, such as a triplex pump is a fairly massive piece of equipment exceeding about 5,000 pounds in weight. Further, the capacity of a triplex or crankshaft driven pump 101 exceeds pressure requirements to complete many oilfield applications such as certain lower pressure fracturing applications or the clean out application as described here. Additionally, the capacity of such a pump 101 far exceeds the minimal pressure required to avoid collapse of the advancing coiled tubing 160 for the operation shown in FIGS. 1 and 3.

In addition to the above described inefficiency of a crankshaft driven pump 101 for a coiled tubing application as shown, the crankshaft driven pump 101 operates by way of a conventional crankshaft 115 as indicated. This leads to the significantly larger size of the crankshaft driven pump 101. As is apparent in FIG. 2, such a triplex crankshaft driven pump 101 dwarfs a hydraulic treating pump 200. By way of comparison, a crankshaft driven pump 101 may be several thousand pounds as indicated and perhaps the size of a small car. As described further herein, however, a hydraulic treating pump 200 may be employed that does not require a conventional crankshaft in order to operate. Instead, as shown in the exemplary embodiment of FIGS. 5A and 5B and described further below, the hydraulic treating pump 200 includes a single piston which reciprocates between multiple fluid chambers, thus allowing for a much more compact and lightweight overall structure. As a result, the hydraulic treating pump 200 may be less than about four feet long at its largest dimension and less than about 250 pounds at the most. Therefore, as described in greater detail below, the size of the hydraulic treating pump 200 allows it to be integrated directly into a coiled tubing tractor trailer 123 or other application trailer or skid assembly, thereby significantly reducing the total amount of capital equipment required at an oilfield 185 for a given operation (see FIG. 3). This is in contrast to the crankshaft driven pump 101, which is so large that is must be placed on a separate trailer 103.

With particular reference to FIG. 3 an embodiment of a coiled tubing operation at the oilfield 185 of FIG. 1 is now shown in which a single tractor trailer assembly 323 may be employed for the entire operation. Just as the coiled tubing operation of FIG. 1, the operation shown in FIG. 3 involves the advancement of coiled tubing 160 and an application tool 165 through a well 163 and to a fracture site 189 for clean out of debris 187 thereat. However, again, other types of well access assemblies utilizing other forms of well access lines for a variety of applications may be employed. In the particular embodiment shown, the well access line is coiled tubing 160 which may be highly deformable carbon steel pipe of between about 10,000 and about 30,000 feet long with an outer diameter of between about 1.25 inches and about 2.875 inches.

The equipment provided for the coiled tubing operation of FIG. 3 may all be provided on the single coiled tubing trailer assembly 323. As would be expected, the coiled tubing tractor trailer assembly 323 includes a coiled tubing platform 125 to accommodate a coiled tubing reel 150. The platform 125 also accommodates a prime mover 122 and a positioning pump 121 similar to that of the prior art. However, rather than employing an entirely separate high pressure trailer 103 and related equipment (see FIG. 1), a high pressure hydraulic treating pump 200 is integrated into the assembly right on the coiled tubing platform 125. This is possible given the smaller size of the hydraulic treating pump 200. This smaller size is made possible by the elimination of a crankshaft mechanism in the hydraulic treating pump 200, in combination with lower capacity horsepower as detailed further below. Thus, the hydraulic treating pump 200 may be a better fit for a coiled tubing application as shown in FIG. 3 as opposed to a triplex crankshaft driven pump 101 (see FIG. 1).

Continuing with reference to FIG. 3, the hydraulic treating pump 200 and the positioning pump 121 may both be driven by the same prime mover 122. This may be possible in part due to the hydraulic nature of both pumps 121, 200. In addition, hydraulic power may be supplied to the hydraulic treating pump 200 either by the positioning pump 121 or a separate supply pump 205. The supply pump 205 may be any appropriate hydraulic pump and may be driven by the same prime mover 122 as the hydraulic treating pump 200 and the positioning pump 121 as detailed hereinabove, thus enabling all pumps 121, 200, and 205 and the prime mover 122 to be located on the coiled tubing platform 125 and not requiring a separate prime mover for either of the positioning pump 121, the hydraulic treating pump, or the supply pump 205.

Further, the positioning pump 121 and the supply pump 205 may each be coupled to a manifold 310 for directing the effects thereof through the hydraulic treating pump 200 and/or the injector 172. Given that the maximum horsepower required during the operation is likely to be required by the hydraulic treating pump 200 during the above described clean out, the prime mover 122 may be configured to supply at least this amount of horsepower. For example, in one embodiment, the hydraulic treating pump 200 employs up to about 500 Hp for a clean out application and with the prime mover 122 being a 750 Hp engine, thus, capable of providing more than enough of the required horsepower for the entire operation. Similar parameters may also be employed for a fracturing operation as noted herein.

As shown in FIG. 3 and indicated above, a prime mover 122 provides hydraulic power to both the lower pressure positioning pump 121 and the hydraulic treating pump 200. In turn, the positioning pump 121 may drive the injector 172, which drives the coiled tubing 160. Thus, the coiled tubing 160 may be drawn from the coiled tubing reel 150, through the guide arm 175 and advanced down the well 163. In this manner the application tool 165 may be advanced toward the fracture site 189 for employment thereat as indicated.

As indicated, the prime mover 122 also powers the hydraulic treating pump 200, which, due to its configuration, may be accommodated right at the coiled tubing platform 125. The hydraulic treating pump 200 may be coupled to the coiled tubing reel 150 to provide fluid pressure to the coiled tubing 160 as it is advanced into and within the well 163 as indicated above. In the embodiment shown, the advancement of the coiled tubing 160 through the well 163 may take place over a long period of time such as between a few hours and a week or more. Therefore, the capacity of the hydraulic treating pump 200 to operate at lower horsepower for an extended period of time may be of great value (i.e. as compared to a conventional triplex crankshaft driven pump 101 as shown in FIG. 1).

In one embodiment the hydraulic treating pump 200 is operated with no more than about 100 Hp to provide a pressurized fluid within the coiled tubing 160 to avoid collapse during its advancement within the well 163. The pressure within the coiled tubing 160 maintained by the hydraulic treating pump 200 may be substantially less than the pressure that might later be provided for a high pressure clean out of debris 187. For example, perhaps only between about 100 PSI and about 2500 PSI will be employed to avoid collapse of the coiled tubing 160 during its advancement. Additionally, the hydraulic treating pump 200 may operate in this manner for an extended duration as described.

Furthermore, once the application tool 165 has reached the fracture site 189, the hydraulic treating pump 200 may be provided with added horsepower by the prime mover 122 in order to ensure effective clean out of debris 187 by the application tool 165. The fluid may be delivered at between about 2,500 PSI and about 15,000 PSI, more preferably about 5,000 PSI, in order to allow the application tool 165 to achieve the clean out. However, in an embodiment where fracturing, cementing or other more aggressive operations are to be run, the hydraulic treating pump 200 may provide pressures in excess of 5,000 PSI, perhaps even up to about 20,000 PSI.

A variety of fluids may be employed via the hydraulic treating pump 200 during the above described clean out or prior thereto. These fluids may include water, gelled water, a bentonite water mix, a cryogenic fluid as noted further below, a polymer based fluid such as a water mix with foaming agent, a solid-containing fluid slurry, and a petroleum-based fluid such as straight crude oil, diesel fluid, kerosene, or xylene. Additionally, acid containing fluids may be employed. In one embodiment a 20% to 40% hydrochloric acid mixture is used.

In one embodiment, the supply pump 205 and the positioning pump 121 may be configured to act as back ups for one another. Thus, the need to incur the additional expense associated with providing a host of back up pumps at the oilfield 185 for the coiled tubing operation may be avoided. For example, in case failure of either pump 200, 121, the functioning pump may take over the operation. While the positioning pump 121 is naturally of less horsepower, in the case of a failing supply pump 205 to the hydraulic treating pump 200, use of the positioning pump 121 may still prevent line collapse. Thus, during clean out, the possibility of the application tool 165 becoming trapped in the debris 187 may be minimized.

Similarly, use of the supply pump 205 to the hydraulic treating pump 200 to position the line of coiled tubing 160 by driving the injector 172 may be less efficient than employing the positioning pump 121 for this purpose. However, this capacity of the supply pump 205 to the hydraulic treating pump 200 may come in handy in the case of a failing positioning pump 121. Other forms of backup hydraulics may also be employed. For example, the hydraulic treating pump 200 may be backed up by a pump other than the positioning pump 121, and vice versa, which may be available at the oilfield 185.

In another embodiment, such as that shown in FIG. 4, multiple high pressure hydraulic pumps such as the hydraulic treating pump 200 and a supplemental hydraulic pump 400 may be employed to operate at different parameters during the treating portion of an operation. For example, a first hydraulic treating pump 200 may be configured for a 5,000 PSI delivery and a second hydraulic treating pump 400 may be configured for a 15,000 PSI delivery at the fracture site 189. In such an embodiment either pump may be employed to maintain the integrity of the coiled tubing 160 during positioning thereof in the well 163 in advance of a high pressure application at the fracture site 189 afforded by one of the pumps. Further, pump 400 configured for the high pressure delivery (about 15,000 PSI in the above example,) may provide the high pressure and lower flow as required for pressure testing of the blow out preventer equipment.

Another application of the two hydraulic treating pumps 200, 400 of FIG. 4 is cementing. In such an operation, a cement slurry is applied within the well 163 during a in a manner employing two such pumps 200, 400, preferably with abrasion resistant valves. In such an embodiment, the higher pressure pump 400 may be employed in cases where build up of cement slurry leaves the lower pressure pump 200 unable to complete the cementing application. Nevertheless, employment of the lower pressure pump 200 at the outset of the application may enhance the efficiency of the overall operation.

While the above embodiments are described with reference to a single coiled tubing trailer assembly 323, supplemental equipment may optionally be provided in completing the coiled tubing operation. For example, in one embodiment a hydraulically driven cryogenic or gas pump without a crankshaft, perhaps for liquid nitrogen, may be made available to the operation by way of a separate trailer or skid assembly coupled to the trailer assembly 323 shown. Such a pump may be operated by the already present prime mover 122 of the trailer assembly 323 and/or by another prime mover, such as that of a tractor pulling the cryogenic fluid trailer. In such an embodiment, the gas pump may be coupled to the manifold 310 in order to provide gas pressurization to the operation. Alternatively, a cryogenic fluid tank may be coupled to the coiled tubing trailer assembly 323 as the primary fluid source for the well service operation, such as a clean out. Such supplemental equipment may be coupled to the trailer assembly 323, but apart from the platform 125. That is, the supplemental equipment may not be integrated into or supported on the platform 125, but rather may be separately located at the oilfield 185. Nevertheless, the total equipment required for the operation remains reduced due to the lack of a requirement for separate high pressure trailer assemblies such as that of FIG. 1 (see 103).

Figure 5A:
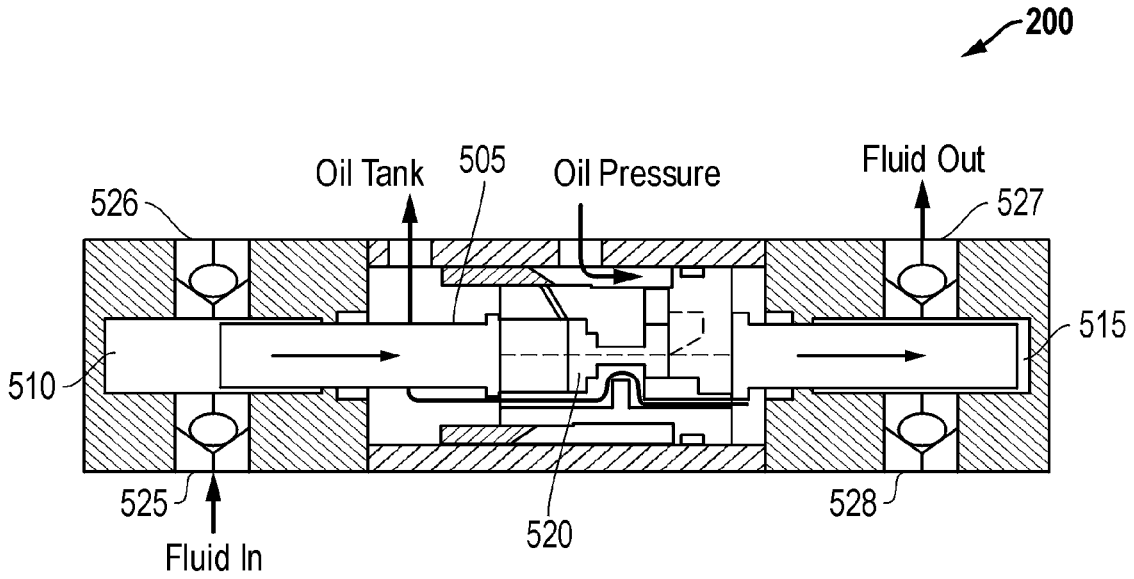
FIG. 5A is a front view of an embodiment of the hydraulic treating pump of FIG. 2 shown in a first position.
Figure 5B:
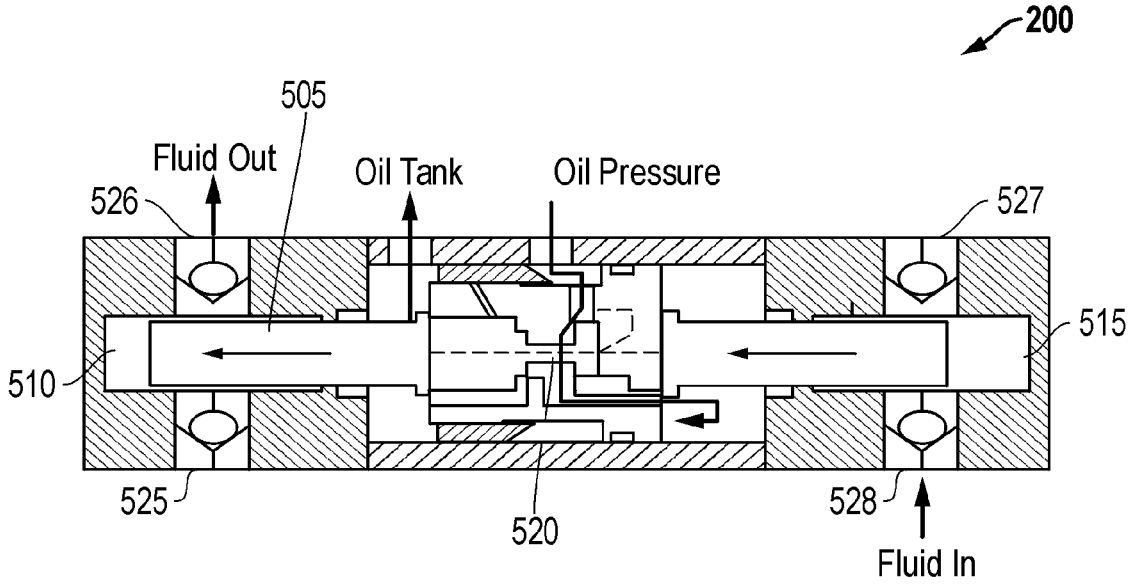
FIG. 5B is a front view of an embodiment of the hydraulic treating pump of FIG. 2 shown in a second position.

Referring now to FIGS. 5A-5B, a configuration of the hydraulic treating pump 200 is shown in greater detail. An example of such a pump is commercially available from Dynaset Limited of Ylojarvi, Finland. For example, suitable pumps for use as the hydraulic treating pump in the assemblies described herein include the Dynaset HPW 800/30-140, and the Dynaset HPW 250/300-350.

The hydraulic intensifying nature of the configuration of the hydraulic treating pump 200 of FIGS. 5A and 5B allows for effective use of the hydraulic treating pump 200 integrated directly into the coiled tubing platform 125 itself. That is, rather than requiring a massive crankshaft driven pump 101 and trailer assembly 103 like that of FIG. 1, the hydraulic treating pump 200 shown in FIGS. 5A and 5B achieves effective pressurization in a much smaller piece of equipment. In the embodiment shown, the treating pressure may also be controlled and limited by valves in the hydraulic supply of such a hydraulic treating pump 200. These valves may be much more precise, more reliable, and less expensive than valves offering a similar function operating in the treating fluid.

Rather than the conventional rotating crankshaft of triplex pumps, a hydraulic treating pump 200 as shown in FIGS. 5A-5B may include a reciprocating plunger or piston 505, which reciprocates between fluid chambers 510 and 515 to effect pressures therein. Unlike the large scale crankshaft driven pump 101 shown in FIG. 1, reciprocation of the piston 505 is achieved in a fluid manner. That is, fluid via a fluid exchange mechanism 520 (in the depicted embodiment the fluid is oil) is used to drive the piston 505 back and forth between fluid chambers 510 and 515 and achieve fairly dramatic pressurization. An internal or external hydraulic reversing valve may be employed in achieving this back and forth movement of the piston 505. That is, such a valve may be used to direct the fluid pressure medium effecting reciprocation of the piston. Additionally, the fluid employed for driving such intensification may be a hydraulic oil. In one embodiment, the hydraulic oil is a mineral hydraulic oil for operating at between about 0° C. and about 95° C. Alternatively, a synthetic oil, bio-oil, automatic transmission fluid, or engine oil may be employed.

In operation, when the piston 505 is moved toward a first of the fluid chambers 515 (as shown in FIG. 5A), a pressure is created which forces fluid from the first fluid chamber 515 out an adjacently positioned discharge valve 527. Simultaneously, this piston movement causes fluid to be drawn into an intake valve 525 positioned adjacent to the opposite or second fluid chamber 505. Similarly, when the piston 505 is moved toward the second fluid chamber 505 (as shown in FIG. 5B), a pressure is created which forces fluid from the second fluid chamber 505 out an adjacently positioned discharge valve 526. Simultaneously, this piston movement causes fluid to be drawn into an intake valve 528 positioned adjacent to the first fluid chamber 515.

A hydraulic treating pump 200 such as that shown in FIGS. 5A-5B may be configured to operate with between about 50 Hp and about 750 Hp applied thereto. For example, in one embodiment about 500 Hp may be employed for the clean out portion of the operation shown in FIG. 3 with lower power utilized for maintaining integrity of the coiled tubing 160 during positioning. In such an embodiment, the hydraulic treating pump 200 may effectively provide up to 20,000 PSI of pressure, although it is likely that the operation will require no more than a maximum of about 5,000 PSI for clean out of debris 187.

The hydraulic treating pump 200 is supported by a base which may be secured to the coiled tubing platform 125. Further, the hydraulic treating pump 200 may include a pressure line whereby pressure generated by the hydraulic treating pump 200 may be delivered to the operation. For example, in one embodiment, the pressure line may be coupled to the manifold 310 for directing fluid pressure from the hydraulic treating pump 200 to the operation.

Figure 6:
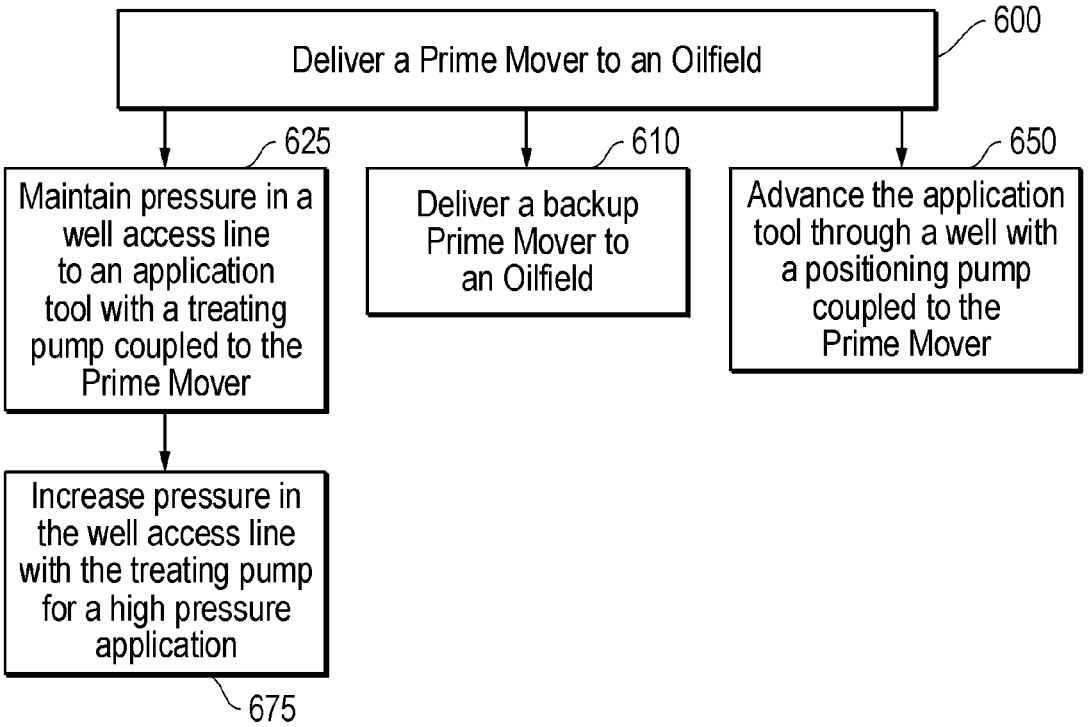
FIG. 6 is a flow-chart summarizing an embodiment of employing a hydraulic treating pump in a manner reducing capital equipment required for an operation at an oilfield.

Referring now to FIG. 6, with added reference to FIG. 3, methods of taking advantage of operational and capital equipment savings afforded by configurations and assemblies described above, are summarized in the form of a flow-chart. For example, as indicated above, a single prime mover 122 is provided at a single trailer assembly 323 that accommodates both a hydraulic treating pump 200 and a positioning pump 121. Each of these pumps 121, 200 may effect an application tool 165 from their respective positions at the single trailer assembly 323.

In light of that above, and with particular reference to FIG. 6, the prime mover may be delivered to an oilfield as indicated at 600, perhaps along with a backup (see 610). Such a backup prime mover may even be equipped with its own hydraulic treating pump such as that described above. Thus, failure of the originally employed prime mover and/or associated hydraulic treating pump may be overcome. In fact, as described above, such a supplemental prime mover and hydraulic treating pump may serve as a functional backup to a positioning pump.

Continuing with reference to FIG. 6, pressure may be maintained by the treating pump to the application tool as indicated at 625 while the tool is advanced in a well via a positioning pump as indicated at 650. In this manner, the line, for example, a coiled tubing line, may be pressurized to an extent necessary to avoid collapse during its advancement into the potentially high pressure well.

With the configuration and methodology described above, less capital equipment may be required at an oilfield operation. For example, use of a single prime mover coupled to both a positioning pump and a treating pump allows all of the required equipment to be accommodated at a single trailer assembly. As indicated above, this may be made possible by the employment of a hydraulic treating pump as opposed to a much more massive conventional triplex and/or crankshaft driven pump. Furthermore, in addition to maintaining pressure, this same treating pump may be employed to increase pressure in the line for a high pressure application, such as a clean out, as indicated at 675.

The embodiments described herein provide tools and techniques for use at an oilfield which employ a single prime mover to operate multiple pumps at a single trailer assembly, thereby reducing the amount of equipment required at an oilfield for a given operation. Such pumps may even act as backups for one another to help ensure the reduction in required capital equipment is maintained. Further, each pump may be independently tailored for contribution to a particular portion of the operation.

In one embodiment a common hydraulic pump (such as the supply pump 205 or the positioning pump 121) supplies pressurized hydraulic fluid to both the hydraulic treating pump 200 and the coiled tubing injector 172. This approach minimizes the total weight of the system and takes greater advantage of the changing distribution of power between the hydraulic treating pump 200 and the coiled tubing injector 172.

In another embodiment an additional prime mover (similar to prime mover 122) is present on location. This prime mover may additionally have a hydraulic treating pump (similar to hydraulic treating pump 200) associated with it. A means is provided to transfer hydraulic power between the two prime movers. By having two prime movers on location and the ability to transfer hydraulic power between them the failure of one prime mover will not result in a loss of treating pumping capability. Further, if the second prime mover is equipped with a hydraulic driven treating pump, the system is also protected against the failure of the hydraulic driven treating pump 200. Finally, the second prime mover can be used to allow the coiled tubing 160 to be removed from the well.

In the above description, the coiled tubing trailer 125 (as shown, for example in FIGS. 3 and 4) has been described as having various equipment disposed thereon including a coiled tubing reel 150. In some cases, the coiled tubing reel 150 is so big and/or so heavy that it requires its own trailer. In such an instance, the coiled tubing trailer 125 may include any of the combinations of equipment described above except for the reel 150, which is disposed on a separate trailer.

Although exemplary embodiments describe certain tools and techniques primarily with reference to a particular coiled tubing application of a well clean out, additional embodiments are possible. For example, embodiments described herein may be applicable to fracturing, cementing, acidizing, logging, well testing, pressure testing, and well killing operations as well. Furthermore, alternate configurations of an integrated well access assembly may be employed. For example, a single hydraulic supply pump 205 may supply pressurized hydraulic fluid to both the hydraulic treating pump 200 and the coiled tubing injector 172 described above. In this manner, the total amount of equipment required for a given operation at an oilfield may be further reduced. Similarly, other changes, modifications, and substitutions may be made without departing from the scope of the described embodiments.

I claim:

1. An assembly for accessing a well, the assembly comprising:

a prime mover;

a positioning pump driven by said prime mover to provide pressurized hydraulic fluid to an injector for positioning a well access line relative to the well;

a hydraulic supply pump driven by said prime mover; and a hydraulic treating pump hydraulically coupled to the hydraulic supply pump, the hydraulic supply pump supplying pressurized hydraulic fluid to said hydraulic treating pump to enable the hydraulic treating pump to pump a fluid into said well access line, wherein the hydraulic treating pump is not a crankshaft driven pump and, wherein the positioning pump and the hydraulic supply pump are each configured as a back up pump for the other of the pumps and wherein the prime mover and each of the pumps are positioned on a coiled tubing platform.

2. The assembly of claim 1, further comprising a tractor trailer, said tractor trailer comprising the platform for receiving said prime mover, said positioning pump, said hydraulic supply pump, and said hydraulic treating pump.

3. The assembly of claim 2, further comprising supplemental equipment coupled to said tractor trailer apart from the platform.

4. The assembly of claim 3, wherein said supplemental equipment is one of a cryogenic pump and a cryogenic fluid tank.

5. The assembly of claim 2, wherein the tractor trailer reduces the total amount of equipment required at an oilfield for a given operation of the assembly.

6. The assembly of claim 1, further comprising a skid, said skid comprising the platform for receiving said prime mover, said positioning pump, said hydraulic supply pump, and said hydraulic treating pump.

7. The assembly of claim 6, wherein the skid reduces the total amount of equipment required at an oilfield for a given operation of the assembly.

8. The assembly of claim 1 wherein the well access line is coiled tubing, the assembly further comprising a coiled tubing reel for accommodating the coiled tubing.

9. The assembly of claim 1 wherein the well access line is a hose reel for use in one of a cementing and a fracturing operation.

10. The assembly of claim 1, wherein said hydraulic treating pump is configured to provide the fluid into the well access line for maintaining integrity of the well access line during the positioning.

11. The assembly of claim 10, wherein said hydraulic treating pump is configured to provide between about 100 PSI and about 2500 PSI of the fluid into the well access line for the maintaining.

12. The assembly of claim 10, wherein said hydraulic treating pump is further configured to provide the fluid into the well access line for an application to occur within the well.

13. The assembly of claim 12, wherein said hydraulic treating pump is configured to provide between about 2,500 PSI and about 20,000 PSI of the fluid into the well access line for the application.

14. The assembly of claim 13, wherein the application includes pressure testing.

15. The assembly of claim 13, wherein the well access line accommodates an application tool for the application, and wherein the application tool is one of a pressure spraying mechanism and a logging tool.

16. The assembly of claim 1, wherein said hydraulic treating pump is configured to operate by employment of between about 50 Hp and about 750 Hp.

17. The assembly of claim 1, wherein said prime mover is configured of a horsepower capacity that exceeds a maximum horsepower employable by said hydraulic treating pump.

18. The assembly of claim 1, wherein the fluid is one of water, gelled water, a bentonite water mix, a cryogenic fluid, a polymer based fluid, a solid containing fluid slurry, a petroleum based fluid, and an acid containing fluid.

19. The assembly of claim 1, further comprising a backup prime mover equipped with a backup hydraulic treating pump and configured to function as a backup to the prime mover and at least the positioning pump and the hydraulic treating pump.

20. An assembly for accessing a well, the assembly comprising:

a prime mover;

a positioning pump driven by said prime mover for positioning a well access line relative to the well;

a hydraulic supply pump driven by said prime mover;

a first hydraulic treating pump hydraulically coupled to the hydraulic supply pump and receiving pressurized hydraulic fluid from said hydraulic supply pump via a common manifold for pumping fluid into the well access line at a first degree of pressurization; and a second hydraulic treating pump hydraulically coupled to the positioning pump and receiving pressurized hydraulic fluid from said positioning pump via the common manifold for pumping fluid into the well access line at a second degree of pressurization greater than the first degree of pressurization, wherein at least one of the first and second hydraulic treating pumps is not a crankshaft driven pump and wherein each of the positioning pump and the hydraulic supply pump is configured as a back up pump for the other of the pumps via the common manifold.

21. A method for use in an oilfield comprising:

providing a tractor trailer, a prime mover, a positioning pump, a supply pump, and a hydraulic treating pump;

mounting the prime mover, the positioning pump, the supply pump, and the hydraulic treating pump on the tractor trailer;

configuring the supply pump and the positioning pump to be driven by the prime mover;

hydraulically coupling the positioning pump to the hydraulic treating pump;

configuring each of the supply pump and the positioning pump as a back up pump for the other of the pumps;

operating the prime mover to activate the positioning pump and the supply pump;

employing the positioning pump to provide pressurized hydraulic fluid to an injector for positioning a well access line relative to a well;

employing the positioning pump to provide pressurized hydraulic fluid to said hydraulic treating pump for pumping a fluid into the well access line, wherein the hydraulic treating pump is not a crankshaft driven pump;

advancing the well access line in the well through a guide arm adjacent the well utilizing the positioning pump and the injector; and performing at least one operation in the well with the well access line.

22. The method of claim 21 wherein the tractor trailer reduces the amount of equipment required at an oilfield for a given operation.

23. The method of claim 21 further comprising providing added horsepower from the prime mover to the hydraulic treating pump when performing the at least one operation.

24. The method of claim 21 wherein performing the at least one operation comprises performing at least one of a fracturing operation, a clean out operation, an acidizing operation, a logging operation, a well testing operation, a pressure testing operation, and a well killing operation.

25. A tractor trailer comprising an assembly for accessing a well disposed thereon, the assembly comprising:

a prime mover;

a positioning pump driven by said prime mover to provide pressurized hydraulic fluid to an injector for positioning a well access line relative to the well;

a supply pump driven by said prime mover; and a hydraulic treating pump receiving pressurized hydraulic fluid from the supply pump to pump a fluid into said well access line, wherein the hydraulic treating pump is not a crankshaft driven pump, wherein the supply pump and the positioning pump are each configured to provide pressurized hydraulic fluid via a common manifold to each of the injector and the hydraulic treating pump, and wherein each of the prime mover, the positioning pump, the supply pump, and the hydraulic treating pump are mounted on the tractor trailer, thereby reducing the amount of equipment required for accessing the well.

* * * * *